US006616329B1

(12) United States Patent
Sasaki et al.

(10) Patent No.: US 6,616,329 B1
(45) Date of Patent: Sep. 9, 2003

(54) MOUNTING STRUCTURE OF ROTATING BEZEL AND WATCH WITH THE SAME

(75) Inventors: Shigemi Sasaki, Chino (JP); Noriaki Ozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/554,950

(22) PCT Filed: Sep. 14, 1999

(86) PCT No.: PCT/JP99/05032

§ 371 (c)(1),
(2), (4) Date: Jun. 23, 2000

(87) PCT Pub. No.: WO00/17715

PCT Pub. Date: Mar. 30, 2000

(30) Foreign Application Priority Data

Sep. 22, 1998 (JP) ..... 10-268535

(51) Int. Cl.[7] ..... G04B 37/00; G04B 39/00; G04B 29/00

(52) U.S. Cl. ..... 368/294; 368/295; 368/299; 368/300

(58) Field of Search ..... 368/88, 276, 281, 368/294–295, 297–300

(56) References Cited

U.S. PATENT DOCUMENTS 3,662,537 A * 5/1972 Fujimori
4,815,053 A * 3/1989 Dal Busco ..... 368/294
4,975,893 A * 12/1990 Dal Busco ..... 368/294
5,122,997 A * 6/1992 Schneider et al. ..... 368/294
5,319,617 A * 6/1994 Sonoda ..... 368/294
5,541,895 A * 7/1996 Nussbaum ..... 368/295
5,822,279 A * 10/1998 Cuche et al. ..... 368/295

FOREIGN PATENT DOCUMENTS

| | | |
|---|---|---|
| CH | 631 592 A3 | 8/1992 |
| JP | 50-123375 | 9/1975 |
| JP | 4-11489 | 1/1992 |
| JP | 5-188159 | 7/1993 |
| JP | 7-128459 | 5/1995 |

* cited by examiner

*Primary Examiner*—Vit Miska

(57) ABSTRACT

In a structure in which a rotating bezel is mounted on a case body, the present invention provides the structure which permits the rotating bezel to be mounted and removed without difficulty even if a brittle material and a deformation difficult material is used in the rotating bezel. When the rotating bezel 25 is pushed downward, the lower end of the engaging rib 25*a* of the rotating bezel 25 is abutted against the upper end of the holding rib 21*d* of a glass fixing ring 21 and stress is applied thereby so that the elastically deformable section 21*b* of the glass fixing ring 21 is elastically deformed inward, that is, toward the side where a clearance is formed. As a result, the engaging rib 25*a* goes over the holding rib 21*d* and the rotating bezel 25 is kept in a held state as shown in the figure.

17 Claims, 9 Drawing Sheets

MOUNTING STRUCTURE OF ROTATING BEZEL AND WATCH WITH THE SAME

TECHNICAL FIELD

The present invention relates to a mounting structure of a rotating bezel and a watch using the same, and more particularly, to a mounting structure of a rotating bezel which is preferable when it is employed by a wrist watch with a rotating bezel.

BACKGROUND ART

Conventionally, wrist watches and the like are arranged such that an annular rotating bezel is rotatably mounted around the display section of a watch case as a main body so that a period of time passed from a certain time, and the like can be easily found by the relationship between hands in the display section and a bezel display such as gradations or the like drawn on the surface of the rotating bezel. In particular, rotating bezels which also serve as exterior designs are often used in diver's watches, sport watches and the like.

FIG. 9 shows an enlarged sectional view of a typical example of this type of a wrist watch. As shown in the figure, a glass fixing ring 11 is screwed on a watch case (barrel) 10 in this example, and a cover glass 12 is fixed to the inner periphery of the watch case 10 through a packing 13. The cover glass 12 is held by the glass fixing ring 11. A ring-shaped rotating bezel 15 is engaged with the outer peripheral surface of the glass fixing ring 11 and rotatably held thereby through a rubber packing 16.

A holding rib 11*a*, which annularly extends, is formed on the outer peripheral surface of the glass fixing ring 11, and an annular engaging rib 15*a*, which is formed so as to correspond to the holding rib 11*a*, is disposed on the inner peripheral surface of the rotating bezel 15. The glass fixing ring 11 and the rotating bezel 15 are ordinarily composed of a metal such as stainless steel, titanium alloy and the like. The engaging rib 15*a* of the rotating bezel 15 and the holding rib 11*a* of the glass fixing ring 11 are temporarily deformed by pressing the rotating bezel 15 against the glass fixing ring 11 so that the rotating bezel 15 is fitted to and mounted on the watch case 10. Many of rotating bezels are also abutted against the outer peripheral surface of the watch case so that the easily rotating property thereof to the watch case 10 is guaranteed by an insert member 17 such as a leaf spring, a bezel sheet or the like.

Note that while the above example shows the mounting structure of the rotating bezel in the case body of a one-piece type wrist watch, there is case in which the rotating bezel is directly mounted on the watch case or a bezel, or that it is mounted on the glass fixing ring and held thereby as described above.

However, in the mounting structure of the above rotating bezel 15, since the rotating bezel 15 is fitted by temporarily deforming it and the glass fixing ring 11, unless the materials of the rotating bezel 15 and the glass fixing ring or the watch case are carefully selected, there is caused a problem in that engagement is made impossible, or rotation of the rotating bezel is defectively performed due to damage to, deformation of an engaging portion, or generation of chips.

For example, the rotating bezel 15 has a problem that a brittle material such as ceramics, glass and the like, which have danger of breakage and a hard material such as cemented carbide and the like, which are difficult to be deformed, cannot be used as the material thereof. As a result, there is a drawback that a material cannot help being selected in a narrow range in equipment such as a wrist watch and the like which are provided with the rotating bezel and restriction also is imposed on the design thereof.

Further, even if a metal material is used in the rotating bezel 15, when pure titanium and titanium alloy are used, the following problem arises. That is, since these raw materials are viscous material, the rotating bezel 15 is plastically deformed when it is mounted, by which it is made impossible to hold the rotating bezel 15. Further, since a clearance cannot be secured in the engaging portion between the rotating bezel and the glass fixing ring or the watch case, defective rotation is caused, or when it is intended to remove the rotating bezel for repair or cleaning, it is fixedly attached to the glass fixing ring or the watch case and cannot be removed therefrom.

DISCLOSURE OF THE INVENTION

An object of the present invention, which was made to solve the above problems, is to provide a structure in which a rotating bezel is mounted on a case body, the structure being arranged such that even if a brittle material, a deformation difficult material, or a deformable material and the like are used in the rotating bezel, the rotating bezel can be mounted and removed without difficulty.

A measure applied by the present invention to solve the above problems is a mounting structure of a rotating bezel which is characterized in that a holding portion which has annular rotating bezel rotatably mounted on the outer surface portion of a case body and has an engaging structure for holding the rotating bezel in the case body with said holding portion capable of being elastically deformed in the radial direction of said rotating bezel as well as a clearance is formed to permit said holding portion to elastically deform in the radial direction of said rotating bezel.

According to the means, since the holding portion can be elastically deformed in the radial direction of the rotating bezel as well as the clearance for permitting the elastic deformation is formed, when the rotating bezel is engaged with the case body, the holding portion is deformed to permit the rotating bezel 25 to be directly or indirectly engaged with the case body and the holding portion is returned to its original state by elasticity in the state that the rotating bezel is directly or indirectly engaged with the case body. As a result, the rotating bezel can be easily mounted and removed, and moreover it is difficult to damage and deform the rotating bezel and the case body. Therefore, the selection of the materials of the respective parts such as the rotating bezel, the case body and the like is less restricted and a degree of flexibility in the design and decoration of the equipment including the rotating bezel can be increased.

The holding portion may be disposed to any of the case body, a different member mounted on the case body, the rotating bezel, and a different member mounted on the rotating bezel. Further, the holding portion may be disposed on both the case body side and the rotating bezel side.

It is preferable that the holding portion is composed of a different member which is directly or indirectly mounted on and fixed to the case body or the rotating bezel. The restriction in the selection of the materials of the case body and the rotating bezel can be more reduced by composing the holding portion of the different member without disposing it to the case body or the rotating bezel itself, whereby the degree of flexibility of the design and decoration of the entire equipment can be increased. In this case, the different member can be mounted and fixed in such a manner that it is jointed to the case body, the rotating bezel or a still different member mounted thereon by screwing, fixing through a fixing screw, welding, bonding and the like.

It is preferable that said holding portion includes a connecting section, which is directly or indirectly connected to the case body or to said rotating bezel, and an elastically deformable section, which extends from said connecting section along the outer surface of the case body or a different member directly or indirectly fixed to the case body or along the outer surface of said rotating bezel or a different member directly or indirectly connected to said rotating bezel in the state said clearance keeps to be secured. Since the holding portion is provided with the elastically deformable section which extends from the connecting section (which corresponds to a coupling section when it is arranged integrally with the case body, the rotating bezel or the different member and to a mounting section when it is arranged as the different member) along the outer surface of the case body, the rotating bezel or the different member in the state in which said clearance keeps to be secured, the holding portion can be sufficiently elastically deformed while suppressing the increase of the equipment in size when the rotating bezel is mounted and removed. Moreover, an amount of plastic deformation (permanent deformation) and permanent stress can be reduced by increasing the length of the elastically deformable section in a direction which intersects a deforming direction.

It is preferable that the holding portion is directly or indirectly connected to the case body or the rotating bezel also on a side opposite to the connecting section when viewed from the elastically deformable section and the elastically deformable section is supported on both sides.

The support of the elastically deformable member on both the sides prevents the plastic deformation (permanent deformation) of the elastically deformable member while permitting the rotating bezel to be easily mounted and removed and enables the holding function of the rotating bezel to be maintained.

It is preferable that the holding portion is a window holding member for holding a transparent window member which covers a display portion disposed in the cleaning member. Since the rotating bezel can be held without using a different member by the use of the window holding member as the holding portion, the size of the equipment can be reduced, the number of parts can be decreased and an assembling job can be simplified. The window holding member corresponds to a bezel and a glass fixing ring in, for example, a watch.

It is preferable that the holding portion includes the elastically deformable section between a connecting section which is directly or indirectly connected to the case body and a window holding section where the transparent window member is held. The provision of the elastically deformable section between the connecting section and the window holding section prevents the plastic deformation because the elastically deformable section is supported on both the sides as well as the size of the holding portion can be reduced and a volume occupied by the holding portion can be decreased, and further the size of the equipment can be reduced.

Further it is preferable that a watch includes the mounting structure of one of the above rotating bezels and the case body as a watch case.

Various materials, for example, ceramics, cermet, precious stone, cemented carbide and the like, which cannot be conventionally used from the view point of brittleness, a difficult-to-deform property and the like, also can be used by arranging the holding portion as the member different from the rotating bezel or forming it as a part of the case body by the above means. Further, the range of selection of the material of the case body can be widened similarly to the above by arranging the holding portion as the member different from the case body.

Further, in the above respective means, it is preferable that the clearance is larger than an amount of deformation of the engaging portion when the rotating bezel is engaged with the holding portion. In other words, it is preferable that the clearance is larger than an amount of overlap of the engaging portion (in the radial direction of the rotating bezel) of the rotating bezel and the holding portion in the state in which the rotating bezel is mounted. Further, when the holding portion is provided with each of the rotating bezel side and the case body side as well as a clearance is formed to each holding portion, it is preferable that a total of both the clearances is larger than the above amount of overlap.

BEST MODE OF CARRYING OUT THE INVENTION

Next, embodiments according to the present invention will be described in detail. The respective embodiments described below show examples in which they are arranged as wrist watches (diver's watches, sport watches and the like) provided with a rotating bezel. However, the present invention is not limited to the wrist watches and can be applied to various types of watches so long as they include a rotating bezel. Further, the present invention also can be applied to various types of equipment such as various types of portable equipment and the like other than the watches which are provided with the rotating bezel as gradations and decoration similarly to the wrist watches and to various types of equipment and the like which are provided with the rotating bezel as an operating switch in the same way.

Figure 1:
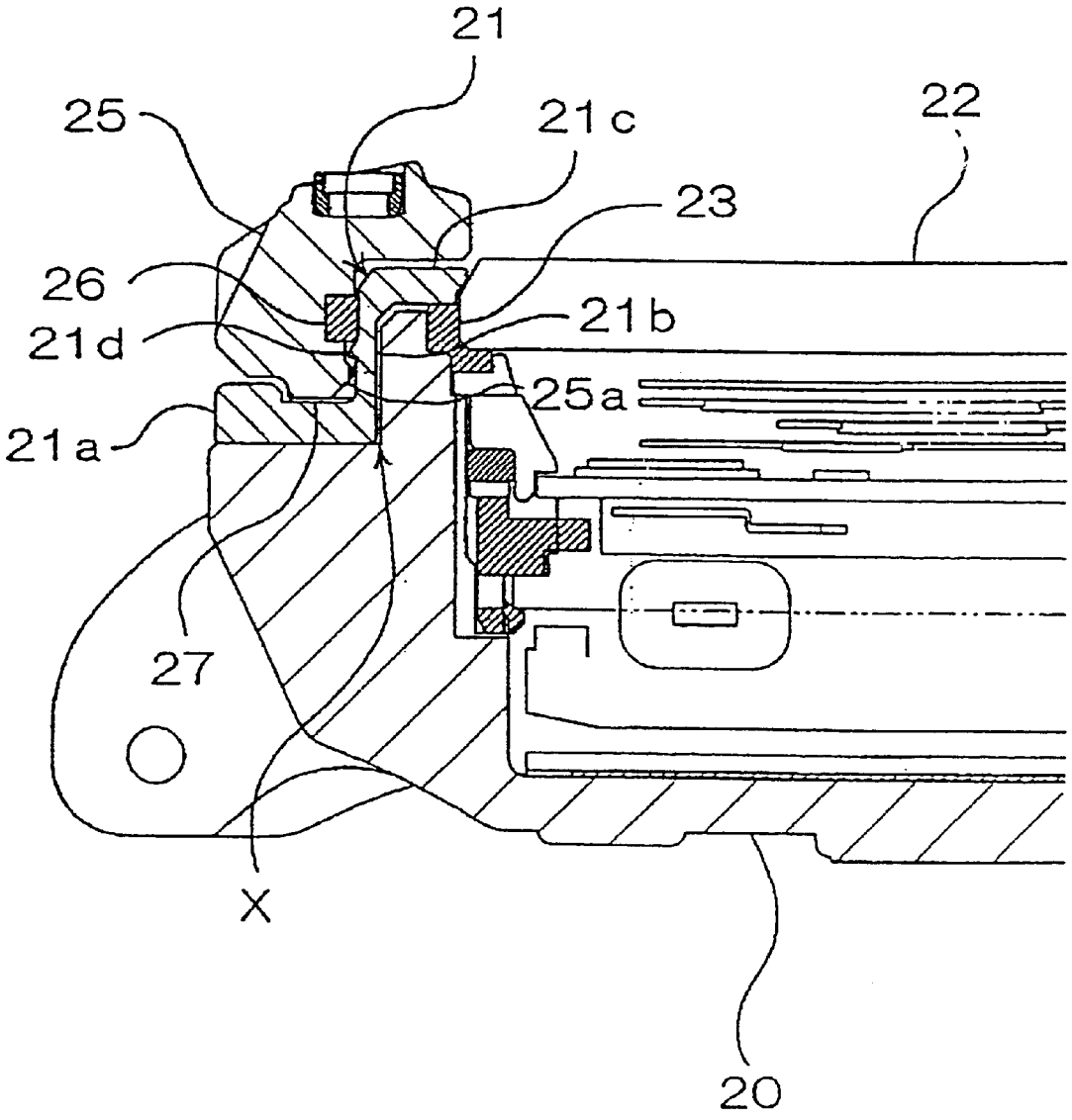
FIG. 1 is an enlarged view, partly in cross section, of a wrist watch showing a first embodiment of a mounting structure of a rotating bezel according to the present invention.
Figure 2:
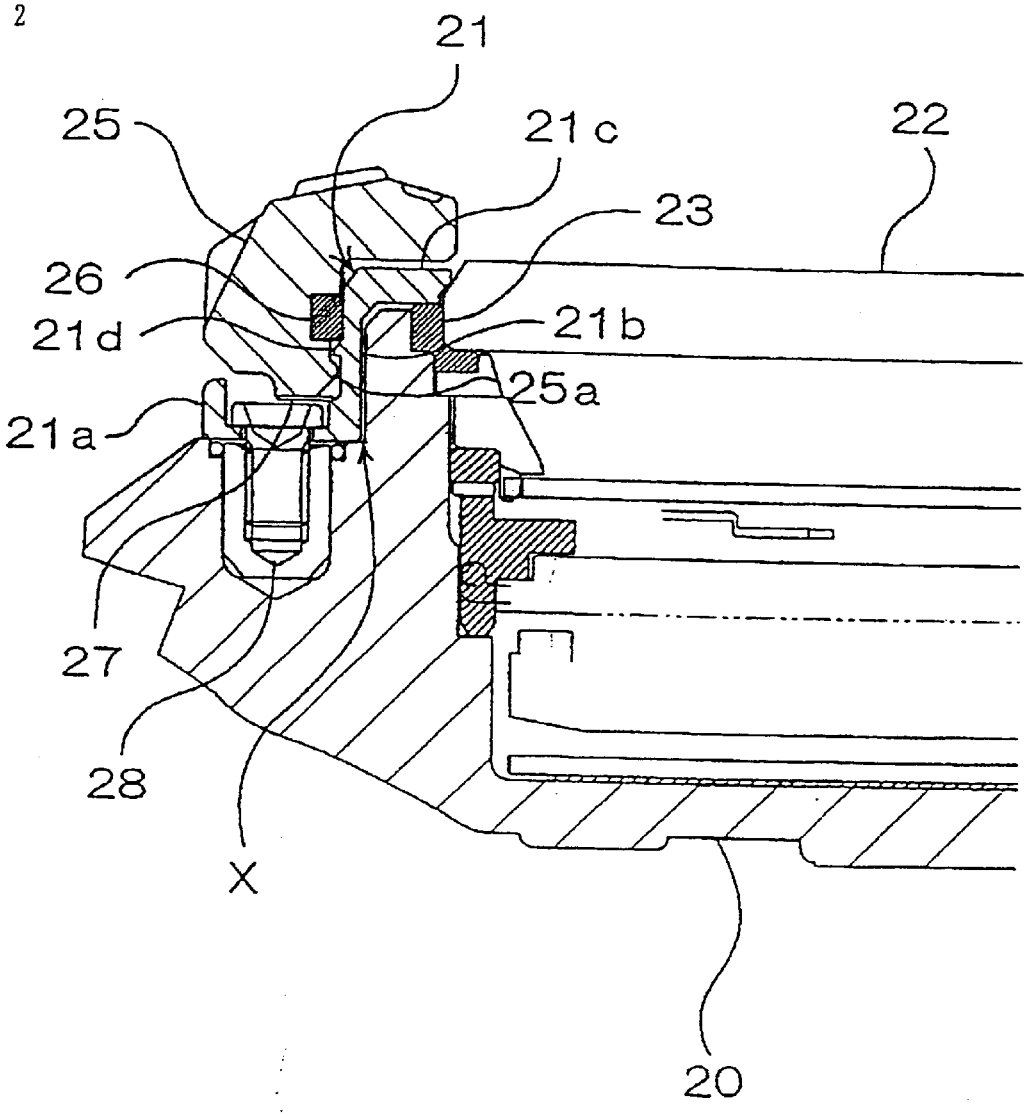
FIG. 2 is an enlarged view, partly in cross section, of a different portion of the first embodiment of the mounting structure of the rotating bezel.

FIGS. 1 and 2 are enlarged views, partly in cross section, showing a structure of a first embodiment according to the present invention. An annular glass fixing ring 21 is fixed on the upper portion of a watch case 20 by a fixing screw 28 shown in FIG. 2. A cover glass 22 is fixed to the inside of the upper portion of the glass fixing ring 21 through a packing 23. The glass fixing ring 21 includes a mounting section 21*a*, which is connected and fixed to the upper surface of the watch case 20 at a location near to the outer peripheral portion thereof by the fixing screw 28, an elastically deformable section 21*b*, which extends from the inner end portion of the mounting section 21*a* upward along the outer surface of the watch case 20 while keeping a predetermined interval thereto, and a holding section 21*c*, which extends inwardly from the elastically deformable section 21*b* and holds the cover glass 22 at the inner end portion thereof.

A rotating bezel 25 is engaged with the outer peripheral surface of the glass fixing ring 21 through a rubber packing 26. An annular holding rib 21*d* is disposed around the outer peripheral surface of the glass fixing ring 21. On the other hand, an engaging rib 25*a* is formed around the inner peripheral surface of the rotating bezel 25 and located below the holding rib 21*d*. The rotating bezel 25 is held by the watch case 20 in such a manner that the engaging rib 25*a* is blocked by the holding rib 21*d*.

The bottom surface portion of the rotating bezel 25 is accommodated in an annular recessed groove which is formed on the upper surface of the mounting section 21*a* of the glass fixing ring 21 through an insert member 27. The insert member 27 is a bezel sheet for easily rotating the rotating bezel 25, a leaf spring for pushing the rotating bezel upward as well as giving a light feeling of click to the rotating bezel 25 when it is rotated.

The embodiment is arranged such that the glass fixing ring 21, which is mounted on and fixed to the watch case 20 through the mounting section 21*a* located at the lower portion of the glass fixing ring 21 and serving as a connecting section, extends upward along the outer surface of the watch case 20 while keeping the predetermined clearance (X shown in FIG. 1) between it and the outer surface, is made to the elastically deformable section 21*b* and then bent inward so as to be made to the holding section 21*c*. Therefore, when the rotating bezel 25 is pushed downward, the lower end of the engaging rib 25*a* of the rotating bezel 25 is abutted against the upper end of the holding rib 21*d* of the glass fixing ring 21 and stress is applied thereby, whereby the elastically deformable section 21*b* of the glass fixing ring 21 is elastically deformed inwardly, that is, toward the side where the clearance is formed. As a result, the engaging rib 25*a* goes over the holding rib 21*d* so that the rotating bezel 25 is in an held state as shown in the figure.

Contrary to the above, when the rotating bezel 25 is removed from the watch case 20, the elastically deformable section 21*b* of the glass fixing ring 21 is deformed, whereby the rotating bezel 25 can be easily removed.

It is preferable that the clearance formed between the elastically deformable section 21*b* of the glass fixing ring 21 and the outer surface of the watch case 20 is larger than an amount of deformation which is necessary for the rotating bezel 25 to be engaged with the glass fixing ring 21. For example, when an amount of overlap of the holding rib 21*d* and the engaging rib 25*a* in a right to left direction in the figure is 55 $\mu$m in the state in which the rotating bezel 25 mounted, it is preferable that the clearance is set to about 100 $\mu$m.

In the embodiment, since the elastically deformable section 21*b* is formed so as to extend from the mounting section 21*a* of the glass fixing ring 21 along the outer surface of the watch case 20, a distance from the mounting section 21*a* to the elastically deformable section 21*b* can be increased, whereby the glass fixing ring 21 can be sufficiently deformed. In particular, since the elastically deformable section 21*b* is interposed between the mounting section 21*a* and the holding section 21*c*, the watch case 20 can be formed without making it to a special shape. Further, since the elastically deformable section 21*b* is fixed on both the sides thereof by the mounting section 21*a* and the glass holding section 21*c* (since the glass holding section 21*c* holds the cover glass 22, it is not deformed in the radial direction (right direction shown in the figure) of the rotating bezel 25), even if the elastically deformable section 21*b* is deformed once, it is instantly returned to its original shape when stress is removed therefrom so that the rotating bezel 25 can be reliably secured by the holding section 21*c*.

Further, the glass fixing ring 21, which constitutes the holding portion in the embodiment, forms the mounting section 21*a* substantially parallel to the surface of a face, the elastically deformable section 21*b* substantially vertical to the surface of the face, and the holding section 21*c* substantially parallel to the surface of the face with respect to the watch case 20, whereby the surrounding of the face with respect to the watch case 20. Accordingly, there also is an advantage that the glass fixing ring 21 is reliably fixed to the watch case 20 as well as the glass fixing ring 21 can be formed in a thin type while securing the deformation of the elastically deformable section elastically deformable section 21*b* in a radial direction, whereby the reduction of thickness of the rotating bezel 25 is not prevented.

Figure 9:
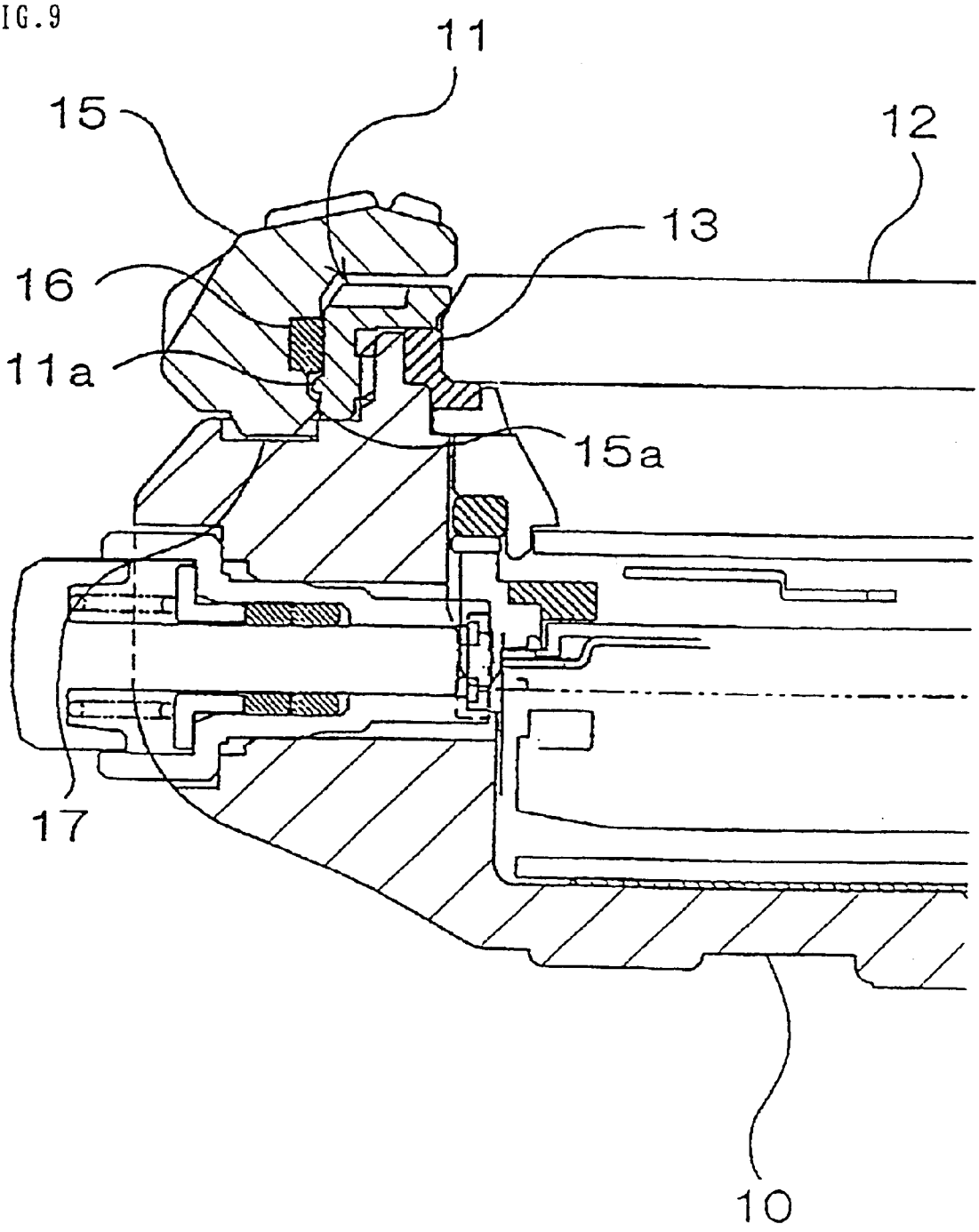
FIG. 9 is an enlarged view, partly in cross section, showing an example of a structure of a wrist watch provided with a conventional rotating bezel.

In contrast, in the conventional structure shown in FIG. 9, all the stress resulting from the insertion of the rotating bezel 15 is concentrated on an engaging portion because a screwing section to the watch case 10 exists on the inside of the glass fixing ring 11 and thus it is entirely impossible for the glass fixing ring 11 to deform inwardly.

In the embodiment, when the rotating bezel 25 is inserted, since the glass fixing ring 21, which is mounted on and fixed to the watch case 20, can be deformed in the radial direction of the rotating bezel, the possibility that the engaging portion of the rotating bezel 25 with the glass fixing ring 21 is damaged or deformed can be lowered.

Note that while the rotating bezel is engaged with the glass fixing ring 21 in the embodiment, it may be engaged with the watch case 20 itself when the elastically deformable portion is provided integrally with the watch case 20 and has a clearance between it and the other portion of the watch case. Further, the rotating bezel may be engaged with a part mounted on and fixed to the watch case 20 other than the glass fixing ring 21, for example, a bezel, a decorative bezel or the like.

The material of the glass fixing ring 21 having the elastically deformable section 21*b* may be any material so long as it has elasticity sufficient to give no damage or deformation to the engaging portion of the rotating bezel 25 with the glass fixing ring 21 when the rotating bezel 25 is assembled in the equilibrium with the shape of the elastically deformable section 21*b*. A metal material having a certain degree of hardness is preferable as a material which has a sufficient amount of elasticity as well as is difficult to be deformed and, for example, stainless steel, pure titanium, titanium alloy and the like can be employed as the metal material.

Figure 3:
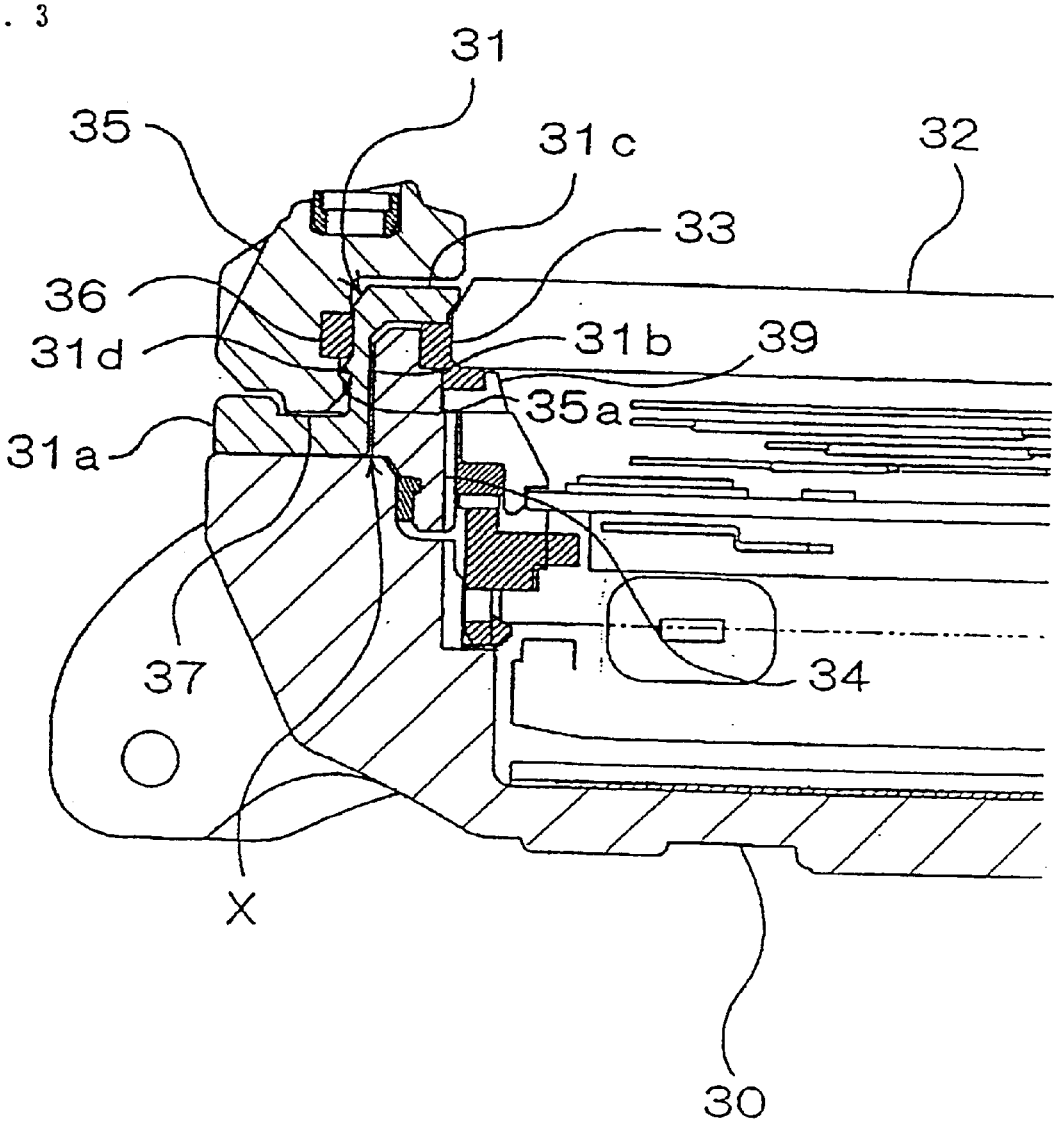
FIG. 3 is an enlarged view, partly in cross section, of a wrist watch showing a second embodiment of the mounting structure of the rotating bezel according to the present invention.
Figure 4:
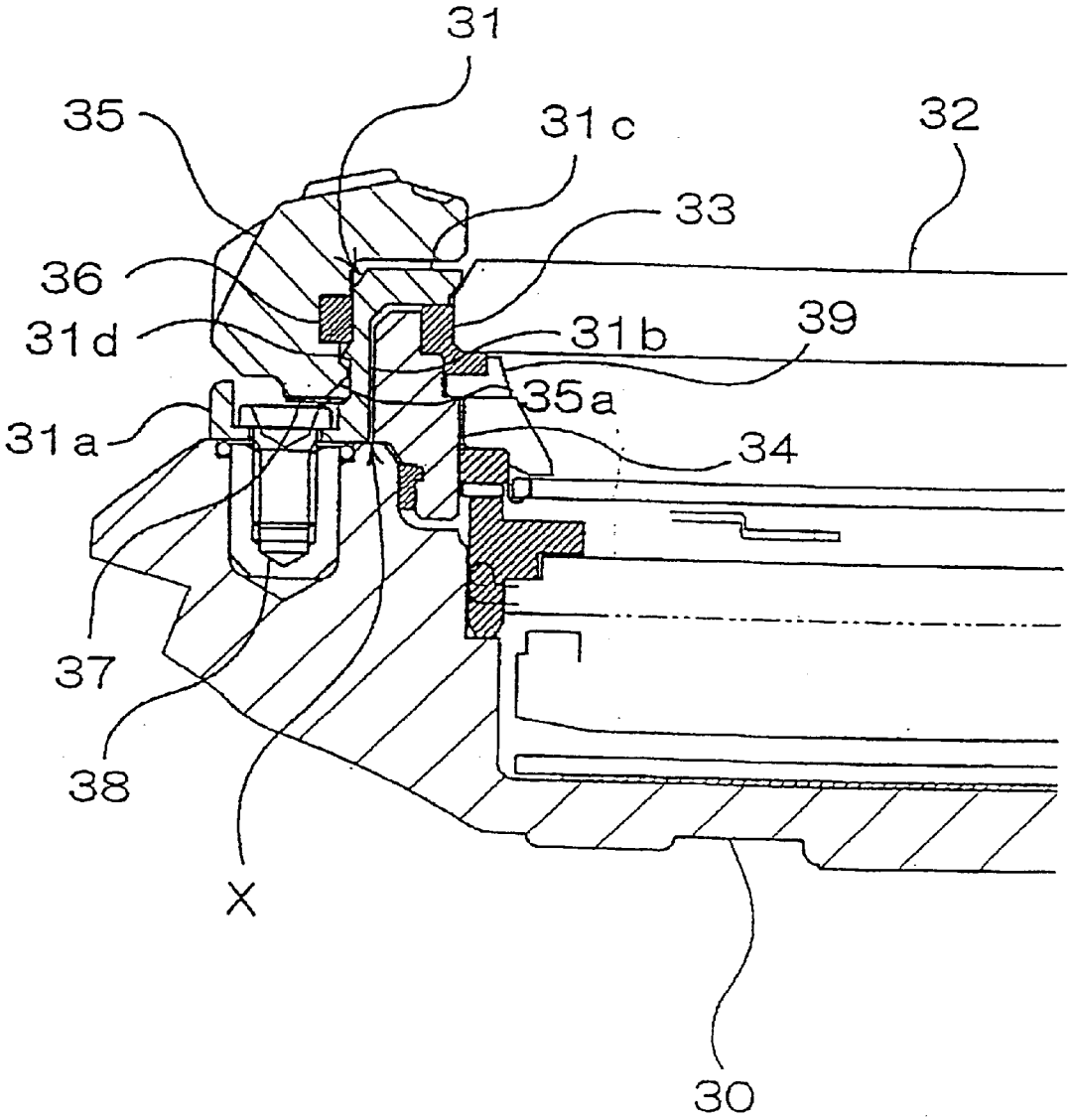
FIG. 4 is an enlarged view, partly in cross section, of a different portion of the second embodiment of the mounting structure of the rotating bezel.

Next, a second embodiment according to the present invention will be described with reference to FIGS. 3 and 4. In the embodiment, a glass fixing ring 31, a cover glass 32, a gasket 33, a rotating bezel 35, a rubber gasket 36, an insert member 37, and a fixing screw 38 are entirely the same as those of the first embodiment.

In the embodiment, a watch case 30 is combined with a metal glass ring (bezel) 34 composed of stainless steel, titanium, titanium alloy and the like, and the cover glass 32 is fixed to the glass ring 34 through the gasket 33. With this arrangement, the watch case can be easily made and a cost can be reduced. The glass ring 34 is forcibly inserted into the watch case 30 through a plastic gasket.

In the embodiment, a clearance X is secured between the elastically deformable section 31*b* of the glass fixing ring 31 and the glass ring 34 so that the rotating bezel 35 can be easily assembled similarly to the first embodiment.

Figure 5:
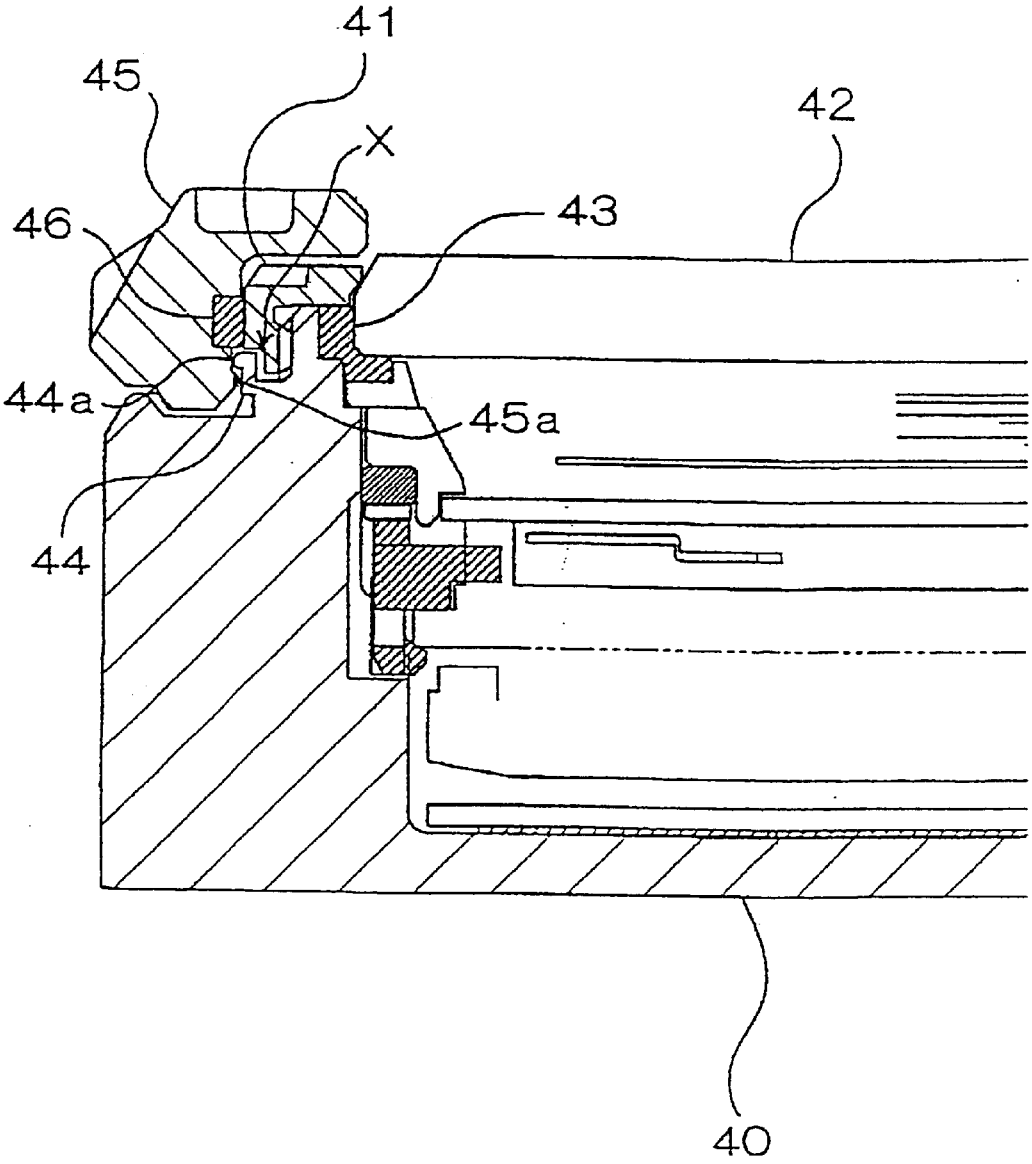
FIG. 5 is an enlarged view, partly in cross section, of a wrist watch showing a third embodiment of the mounting structure of the rotating bezel according to the present invention.

Next, a third embodiment according to the present invention will be described with reference to FIG. 5. Also in the embodiment, since a cover glass 42, a gasket 43, a rotating bezel 45 and a rubber gasket 46 are substantially the same as those of the first embodiment, the description thereof is omitted.

In the embodiment, a glass fixing ring 41 is screwed on the upper opening edge of a watch case 40, and an annular thin holding frame 44, which is located at a, position some what below the glass fixing ring 41, is formed integrally with the watch case 40 or joined thereto by welding or the like. The holding frame 44 is formed so as to be elastically deformed inwardly and outwardly (right and left in the figure) and has a holding rib 44*a* which projects from a position near to the extreme end of the outer peripheral surface thereof.

The holding rib 44*a* prevents the engaging rib 45*a* of a rotating bezel 45 from being removed upward, thereby permitting the rotating bezel 45 to be held in the watch case 40.

In the embodiment, a clearance X is formed between the inner peripheral surface of the holding frame 44 and the lower portion of the outer peripheral surface of the glass fixing ring 41. Thus, the engaging rib 45*a* of the rotating bezel 45 is abutted against the holding rib 44*a* of the holding frame 44 by pressing the rotating bezel 45 downward and deforms the holding frame 44 inwardly, whereby the rotating bezel 45 can be easily made to a held state shown in the figure.

Note that, in the embodiment, the holding frame may be formed independently of the watch case as in the following fourth embodiment. Further, the holding frame may be formed to extend downward in place of that it extends upward as described above.

Figure 6:
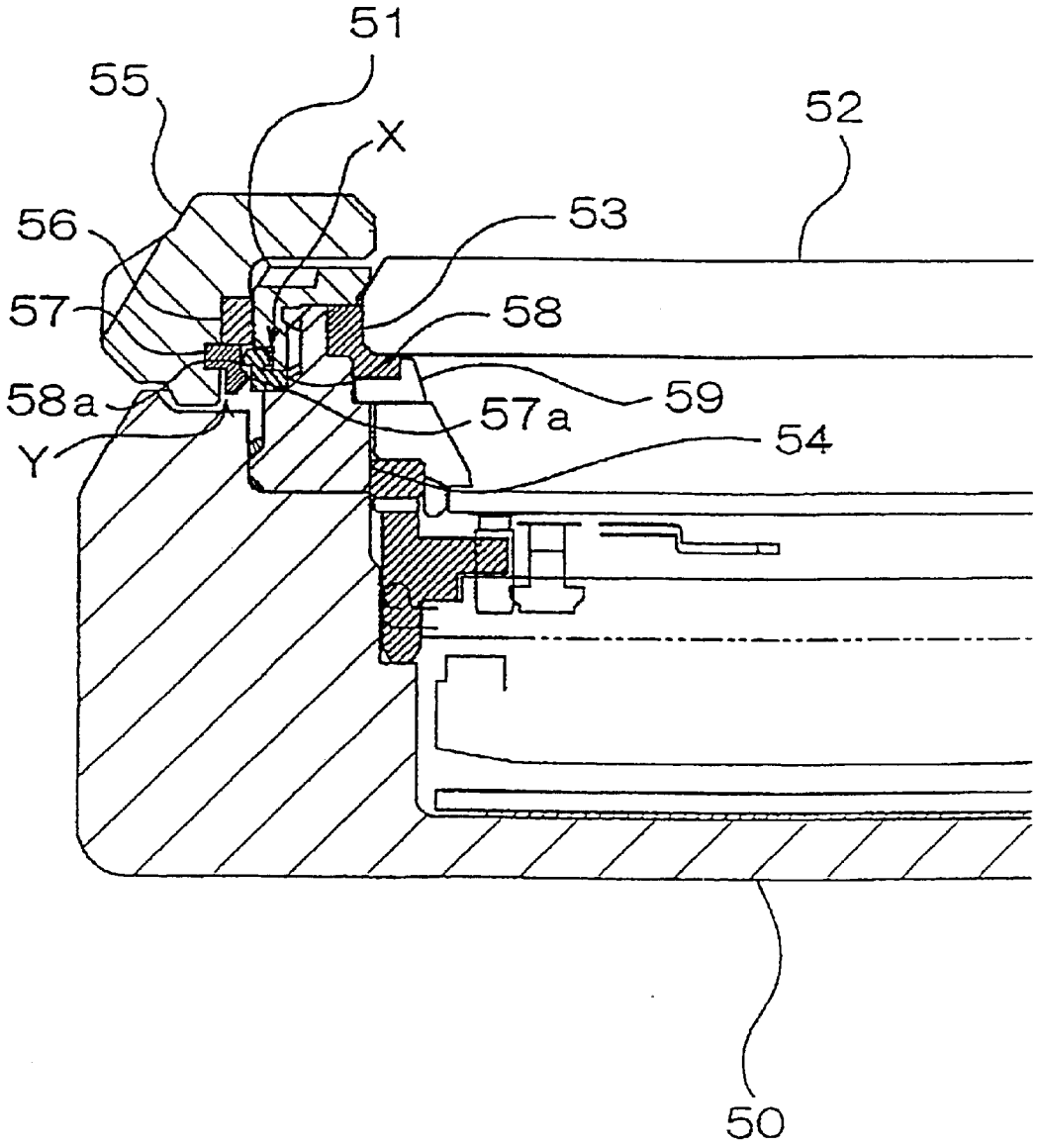
FIG. 6 is an enlarged view, partly in cross section, of a wrist watch showing a fourth embodiment of the mounting structure of the rotating bezel according to the present invention.

Next, a fourth embodiment according to the present invention will be described with reference to FIG. 6. In the embodiment, a glass ring (bezel) 54 composed of a different member is firmly fixed to a watch case 50 by welding or the like, and a cover glass 52 is fixed to the glass ring 54 through a gasket 53. A glass fixing ring 51 is screwed on the glass ring 54.

A holding member 58 is clamped between the glass fixing ring 51 and the glass ring 54, and an engaging member 57, which is forcibly inserted into a rotating bezel 55, is disposed in confrontation with the holding member 58. Both of the holding member 58 and the engaging member 57 are composed of an elastically deformable material, in particular, a metal material and a synthetic resin material. A holding rib 58*a* is formed at an upper portion of the holding member 58 and an engaging rib 57*a* is formed at a lower portion of the engaging member 57.

In the embodiment, a clearance X is formed between the inner peripheral surface of the holding member 58 and a lower portion of the outer peripheral surface of the glass fixing ring 51, and a clearance Y is formed between the outer peripheral surface of the engaging member 57 and a lower portion of the inner peripheral surface of the rotating bezel 55. Therefore, when the rotating bezel 55 is pressed downward against the upper portion of the watch case, the lower portion of the engaging rib 57*a* is abutted against the upper portion of the holding rib 58*a* so that the holding member 58 is deformed inwardly (a right side shown in the figure) and the engaging member 57 is deformed outwardly (a left side shown in the figure), respectively, whereby the rotating bezel 55 can be easily held in the watch case 50.

In this case, it is sufficient that the clearances X and Y are set to permit the holding member 58 and the engaging member 57 to be deformed so that the rotating bezel 55 can be held in the watch case 50. Thus, it is sufficient that a total of the clearances X and Y is larger than an amount of overlap of the holding rib 58*a* and the engaging rib 57*a* in a horizontal direction (in a plane direction or a right to left direction shown in the figure).

In the embodiment, since elastically deformable sections are formed on both the rotating bezel side and the watch case side while the number of parts is increased, the rotating bezel can be more easily mounted and dismounted, whereby the damage and deformation of respective parts can be prevented. Further, since the holding member 58 and the engaging member 57 can be formed of materials which are different from those of the glass ring 54 and the rotating bezel 55, it is possible to design the elastic characteristics of engaging portions more freely. In particular, since the holding member 58 is clamped between the glass ring 54 and the glass fixing ring 51, it is not necessary to join the holding member 58 to these members. As a result, materials can be selected without taking account of joint characteristics.

Note that, in the embodiment, the holding member may be arranged integrally with the watch case as in the above third embodiment. Further, the holding member may be arranged to extend downward in place of that it extends upward as described above.

Further, the engaging member 57 may be firmly fixed to the rotating bezel 55 by welding or bonding or may be screwed on the rotating bezel 55. Furthermore, the engaging member 57 may be arranged integrally with the rotating bezel 55.

In addition, while the engaging member 57 and the holding member 58, which can be elastically deformed, are provided in the above embodiment, any one of them may be formed so long as it can be engaged in its structure.

Figure 7:
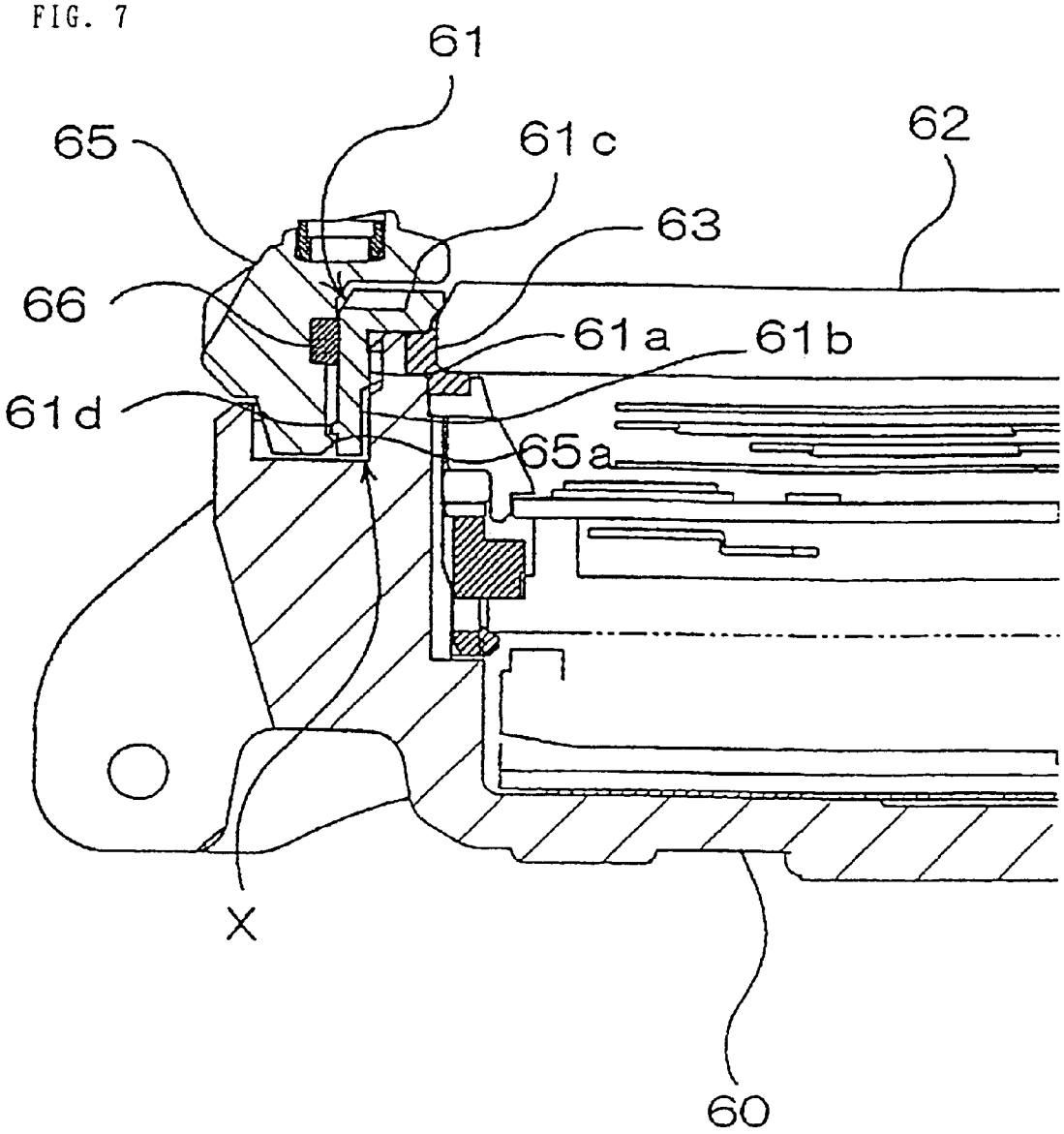
FIG. 7 is an enlarged view, partly in cross section, of a wrist watch showing a fifth embodiment of the mounting structure of the rotating bezel according to the present invention.

Next, a fifth embodiment according to the present invention will be described with reference to FIG. 7. In the embodiment, a glass fixing ring 61 is screwed on a watch case 60, and a cover glass 62 is fixed in the upper opening edge of the watch case 60 through a gasket 63. A rotating bezel 65 is engaged with the glass fixing ring 61 through a rubber gasket 66.

In the embodiment, a glass holding section 61*c* is disposed at an upper portion of the mounting section 61*a* of the glass fixing ring 61, and the glass fixing ring 61 extends downward from the mounting section 61*a* and is arranged as an elastically deformable section 61*b*. A holding rib 61*d* is formed around the outer peripheral surface of the elastically deformable section 61*b* at the lower portion thereof and confronts the inner peripheral surface of the rotating bezel 65 provided with an engaging rib 65*a*. A clearance X is formed between the lower portion of the inner peripheral surface of the glass fixing ring 61 and the outer peripheral surface of the watch case 60 at the upper portion thereof.

In the embodiment, since the elastically deformable section 61*b* is formed by extending the lower portion of the glass fixing ring 61, parts can be easily made, the formation of the elastically deformable section 61*b* is not contrary to the reduction of size and thickness of a watch. In the embodiment, since the elastically deformable section 61*b* is supported on one side different from the first embodiment in which the elastically deformable section 21*b* is supported on both sides, it is preferable that the material of the glass fixing ring 61 has rigidity which is as high as possible.

Figure 8:
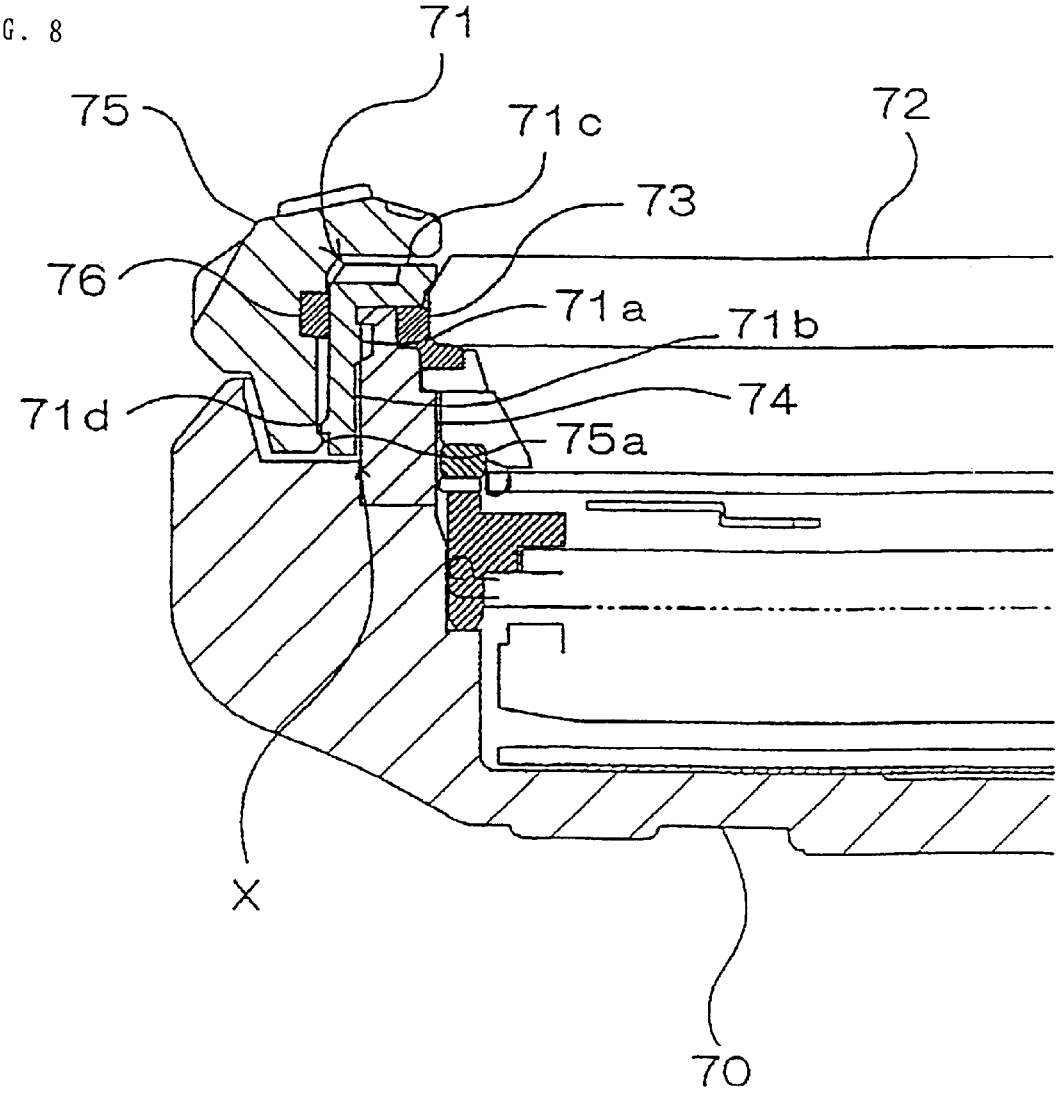
FIG. 8 is an enlarged view, partly in cross section, of the wrist watch showing the fifth embodiment of the mounting structure of the rotating bezel according to the present invention.

Finally, a sixth embodiment according to the present invention will be described with reference to FIG. 8. In the embodiment, since a glass fixing ring 71, a cover glass 72, a gasket 73, and a rotating bezel 75 are the same as those of the fifth embodiment, the description thereof is omitted.

In the embodiment, in order to make machining of a watch case easy, in particular, when the case is composed of a material which is difficult to be subjected to screwing, in order to perform machining easily by applying screwing to a member other than the case, the watch case 70 is formed separately from a glass ring (bezel) 74. The glass ring 74 is firmly fixed to the watch case 70 by welding or the like. The cover glass 72 is fixed to the glass ring 74 through the gasket 73. Further, a clearance X is formed between the elastically deformable section 71*b* of the glass fixing ring 71 and a glass ring 74.

Any of the respective embodiments described above relates to a wrist watch including the one-piece type watch case and the glass fixing ring. However, the watch case may not be of the one-piece type and may be formed in various types of shapes such as, for example, an ordinary watch case sealed with a rear lid, and the like. Further, the glass fixing ring may not exist in the watch. In this case, the holding portion where the glass fixing ring is disposed and the elastically deformable section may be disposed to other member such as the watch case itself, the bezel, and the like.

As described above, according to the present invention, since the holding portion can be elastically deformed in the radial direction of the rotating bezel as well as the clearance is formed to permit the elastic deformation, when the rotating bezel is engaged with the case body, the holding portion is deformed to permit the rotating bezel 25 to be directly or indirectly engaged with the case body and the holding portion is returned to its original shape by elasticity in the state that the rotating bezel is directly or indirectly engaged with the case body. As a result, the rotating bezel can be easily mounted and removed, and moreover the rotating bezel and the case body are difficult to be damaged and deformed. Therefore, the selection of the materials of the respective parts such as the rotating bezel and the case body is less restricted and a degree of flexibility in the design and decoration of the parts including the rotating bezel can be increased.

What is claimed is:

1. A mounting structure of a rotating bezel, comprising:

a rotating bezel rotatably mounted on an outer surface portion of a case body;

a holding portion having an engaging structure for holding said rotating bezel to the case body with said holding portion;

wherein said holding portion is capable of being elastically deformed in the radial direction of said rotating bezel, and a clearance is formed to permit said holding portion to elastically deform into said clearance in the radial direction of said rotating bezel;

wherein said holding portion is composed of a different member that is one of directly and indirectly mounted on, and fixed to, one of said case body and said rotating bezel; and wherein said holding portion is a window holding member for holding a transparent window member which covers a display portion disposed in said case body.

2. A mounting structure of a rotating bezel according to claim 1, wherein said holding portion includes:

a connecting section one of directly and indirectly connected to one of said case body and said rotating bezel; and an elastically deformable section that maintains at least a part of said clearance while extending from at least one of said connecting section along the outer surface of said case body, a different member either directly or indirectly fixed to said case body, along the outer surface of said rotating bezel, and a different member either directly or indirectly connected to said rotating bezel.

3. A mounting structure of a rotating bezel according to claim 2, wherein said holding portion is also directly or indirectly connected to said case body or said rotating bezel on a side opposite to said connecting section as viewed from said elastically deformable section and;

wherein said elastically deformable section is supported on both sides.

4. A mounting structure of a rotating bezel according to claim 1, wherein said holding portion includes said elastically deformable section between said connecting section directly or indirectly connected to said case body and a window holding section for holding said transparent window member.

5. A watch including the mounting structure of a rotating bezel according to claim 1 wherein said case body comprises a watch case.

6. A mounting structure of a rotating bezel, comprising:

a rotating bezel rotatably mounted on an outer surface portion of a case body;

a holding portion having an engaging structure for holding said rotating bezel to the case body with said holding portion, said holding portion being capable of being elastically deformed in the radial direction of said rotating bezel, a clearance being formed to permit said holding portion to elastically deform into said clearance in the radial direction of said rotating bezel, and said holding portion including:

a connecting section one of directly and indirectly connected to one of said case body and said rotating bezel; and an elastically deformable section that maintains at least a part of said clearance while extending from at least one of said connecting section along the outer surface of said case body, a different member either directly or indirectly fixed to said case body, along the outer surface of said rotating bezel, and a different member either directly or indirectly connected to said rotating bezel;

wherein said holding portion is a window holding member for holding a transparent window member that covers a display portion disposed in said case body.

7. A mounting structure of a rotating bezel, comprising:

a rotating bezel rotatably mounted on an outer surface portion of a case body;

a holding portion having an engaging structure for holding said rotating bezel to the case body with said holding portion, said holding portion being capable of being elastically deformed in the radial direction of said rotating bezel, a clearance being formed to permit said holding portion to elastically deform into said clearance in the radial direction of said rotating bezel, and said holding portion including:

a connecting section one of directly and indirectly connected to one of said case body and said rotating bezel; and an elastically deformable section that maintains at least a part of said clearance while extending from at least one of said connecting section along the outer surface of said case body, a different member either directly or indirectly fixed to said case body, along the outer surface of said rotating bezel, and a different member either directly or indirectly connected to said rotating bezel; wherein said holding portion is also directly or indirectly connected to said case body or said rotating bezel on a side opposite to said connecting section as viewed from said elastically deformable section;

said elastically deformable section is supported on both sides; and said holding portion is a window holding member for holding a transparent window member that covers a display portion disposed in said case body.

8. An apparatus comprising:

a case;

a ring coupled to an outer surface of said case;

a bezel rotatably mounted to said ring; and a holding member including an elastically deformable pivot arm interconnecting said bezel and said case;

wherein said holding member is formed on said case.

9. The apparatus of claim 8 wherein said holding member is formed on said ring.

10. A mounting structure of a rotating bezel, comprising:

a resilient pivot arm having an engaging structure built thereon for interlocking with a mating structure, said mating structure being one of directly and indirectly attached to said rotating bezel;

a first anchoring base attached to an end of said resilient pivot arm and effective for applying an opposing torque to a pivoting action on said pivot arm, said first anchoring base being one of directly and indirectly attached to a case body; and a second pivot arm attached to a second anchoring base, said mating structure being constructed on said second pivot arm, said second anchoring base being one of directly and indirectly attached to said rotating bezel.

11. The mounting structure of claim 10, wherein said pivot arm maintains at least a predetermined minimum clearance between itself and its surroundings in a pivoting direction during an applied, deforming pivoting action.

12. The mounting structure of claim 10, wherein said second pivot arm maintains at least a second predetermined minimum clearance between itself and its corresponding surroundings in a corresponding pivoting direction during a correspondingly applied, deforming pivoting action.

13. A mounting structure of a rotating bezel, comprising;

a resilient pivot arm having an engaging structure built thereon for interlocking with a mating structure;

a first anchoring base attached to an end of said resilient pivot arm and effective for applying an opposing torque to a pivoting action on said pivot arm; and a second anchoring base attached to an extreme end of said pivot arm opposite said first anchoring base;

wherein said first and second anchoring bases are attached to a case body and said mating structure is attached to said rotating bezel.

14. The mounting structure of claim 13, wherein said engaging structure is located within a mid-section of said pivot arm, and the torque action of said first and second anchoring bases function to apply a restoring force on said pivot arm toward a default resting position in reaction to a pivot force applied to said pivot arm.

15. The mounting structure of claim 13, wherein either of said first and second anchoring bases are respectively one of directly and indirectly attached to said case body.

16. A watch comprising:

a case body housing a means for tracking the passage of time; and a mounting structure for a rotating bezel as recited in claim 10.

17. A watch comprising:

a case body housing a means for tracking the passage of time; and a mounting structure for a rotating bezel as recited in claim 13.

* * * * *